US006932143B2

(12) United States Patent
Noble

(10) Patent No.: US 6,932,143 B2
(45) Date of Patent: Aug. 23, 2005

(54) METHOD AND APPARATUS FOR CENTRIFUGAL CASTING OF METAL

(76) Inventor: Charles H. Noble, 3610 Vicksburg Dr., Birmingham, AL (US) 35213

( * ) Notice: Subject to any disclaimer, the term of this patent is extended or adjusted under 35 U.S.C. 154(b) by 0 days.

(21) Appl. No.: 10/815,945

(22) Filed: Apr. 2, 2004

(65) Prior Publication Data

US 2005/0011627 A1 Jan. 20, 2005

Related U.S. Application Data

(63) Continuation-in-part of application No. 10/720,689, filed on Nov. 25, 2003, now abandoned.
(60) Provisional application No. 60/428,745, filed on Nov. 25, 2002.

(51) Int. Cl.[7] ..... B22D 13/02
(52) U.S. Cl. ..... 164/114; 164/116; 164/136
(58) Field of Search ..... 164/114, 116, 164/286, 289, 136

(56) References Cited

U.S. PATENT DOCUMENTS

| | | | | |
|---|---|---|---|---|
| 1,581,635 | A | | 4/1926 | Henry et al. |
| 1,697,889 | A | | 1/1929 | Uhrig |
| 1,963,147 | A | | 6/1934 | Russell et al. |
| 1,963,149 | A | | 6/1934 | Russell et al. |
| 2,731,690 | A | | 1/1956 | Coupland, Jr. et al. |
| 3,056,692 | A | | 10/1962 | Kitada |
| 3,110,944 | A | | 11/1963 | Phelps |
| 3,437,131 | A | | 4/1969 | Ornitz |
| 3,944,193 | A | | 3/1976 | Imai et al. |
| 4,150,709 | A | | 4/1979 | Brugger |
| 4,240,492 | A | | 12/1980 | Edwards et al. |
| 4,260,009 | A | | 4/1981 | Noble |
| RE31,482 | E | | 1/1984 | Noble |
| 4,527,610 | A | * | 7/1985 | Krebser et al. ..... 164/287 |
| 4,628,984 | A | | 12/1986 | Noble |
| 4,632,168 | A | | 12/1986 | Noble |
| 6,257,311 | B1 | * | 7/2001 | Brinegar ..... 164/71.1 |

* cited by examiner

*Primary Examiner*—Jonathan Johnson
*Assistant Examiner*—Len Tran
(74) *Attorney, Agent, or Firm*—Roylance, Abrams, Berdo & Goodman, L.L.P.

(57) ABSTRACT

A method and apparatus for centrifugal casting of metal articles uses a rotating mold body that can be pivoted from a vertical orientation to a horizontal orientation during the centrifugal casting of the metal article. The resulting metal article has a closed end and an open end defining a hollow cavity. The mold body has a closed end that is oriented in a vertical position with the longitudinal axis extending vertically. While the mold body is rotated, an amount of molten metal is introduced into the mold body so that the molten metal is distributed along the closed end of the mold body. In one embodiment, the bottom end of the mold body has a frustoconical shaped surface defining the mold cavity. The mold body is then pivoted to a horizontal position while continuously rotating to distribute and cast the metal against the inner surface of the mold body. In one embodiment, the mold body has a refractory lining of a compacted refractory material. The refractory material is introduced into the rotating mold and a blade is contacted with the layer of the refractory material formed on the inner surface while the mold is rotated in a first direction to compact and densify the layer of particles with a flat end of the blade. The rotation of the mold body is then reversed and the sharp edge of the blade is contacted with the compacted layer to shape and contour the mold lining.

13 Claims, 10 Drawing Sheets

METHOD AND APPARATUS FOR CENTRIFUGAL CASTING OF METAL

This application is a continuation-in-part of U.S. patent application Ser. No. 10/720,689, filed Nov. 25, 2003 now abandoned, which claims the benefit of U.S. Provisional Application No. 60/428,745 filed Nov. 25, 2002, which applications are hereby incorporated by reference in their entirety.

FIELD OF THE INVENTION

The present invention is directed to a method for pouring horizontally cast, long thick wall tubular articles having a straight bore.

The invention is also directed to an improved method for pouring horizontally cast, long thick wall tubular articles of straight bore, closed on one end, such as a bomb body.

This invention is an improved method for pouring horizontally cast long thick wall tubular articles having a straight bore closed on one end, and a tapered bore closed on one end. According to the method of this invention, molten metal is poured into a near vertical mold to prevent splashing and the mold is transitioned from the vertical position to one or more inclined positions or to the horizontal position.

BACKGROUND OF THE INVENTION

Centrifugal casting is a common method used for casting tubular metal articles including engine cylinder liners. The centrifugal casting apparatus is typically a cylindrical shaped metal mold that is rotated about the longitudinal axis at sufficient speed to distribute the molten metal along the inner surface of the mold. The molds are generally made of metal and have the inner mold surface covered with a lining material to protect the mold from damage and overheating by contact with molten metal. The lining material also is provided to prevent the molded article from bonding to the mold surface.

One method for applying a lining to centrifugal casting molds applies a slurry of a fine particulate refractory material. The refractory materials are typically zircon powder or silica powder and a binder such as bentonite clay. Applying a slurry of a refractory material to a mold surface has exhibited some success. However, a disadvantage of this method is that the mold requires adequate venting to vent water vapor produced during the casting process.

Other methods of forming a mold lining use a binder material, such as a resin, to bond the particles together and to bond the material to the surface of the mold. These methods can be difficult to apply and form a uniform surface. In addition, the application of a lining material using a binder can be expensive and produce gaseous products by the heat from the molten metal during the casting of the metal article.

The vast majority of centrifugal castings employ horizontal casting. For example, the water pipe industry made of iron in thickness of ¼" to 1" in diameter of 2" to 64" in weights up to 11,510 lbs. in lengths of 18 and 20 feet.

American Centrifugal cast steel tubes in lengths of 20 feet and diameters of 30 inches with wall thickness up to 7 inches, in weights up to 28,800 pounds. Therefore, centrifugal casting is not limited to diameter, length or wall thickness and is geared to much faster production rate and higher yield of 95% compared to the 35% that static casting achieved in the 500-pound ductile iron bomb body program.

However, centrifugally casting horizontally has a serious disadvantage when the article requires a thick heavy wall such as the bomb body. The revolving mold wall will pick up ½ inch of liquid metal rapidly being cast onto the relatively cold surface of the mold. Casting a thick heavy wall article requires a much longer pouring time because the additional metal does not receive the chilling effect of the mold or the friction of the mold wall. Metal that does not receive sufficient speed from friction to overcome the effects of gravity will fall back as rain thus aerating the metal and causing oxidation. Therefore, multiple pours of ½ inch metal thickness or less are required. However, the intermittent cooling between pours by the convection air current causes the inside surface of the metal to solidify before the mid wall section, causing internal porosity shrinkage.

The oxidation of the metal is detrimental to all molten metals during casting. Therefore, there is a need for an improved method for pouring the horizontal centrifugal casting method of thick wall constant bore tubular articles.

Previous U.S. Pat. Nos. Re 17,220, dated Feb. 19, 1929, original U.S. Pat. No. 1,533,780 to Robert F. Wood and U.S. Pat. No. 2,344,020, dated Mar. 14, 1944 to Jacques Boucher relate to producing a centrifugally cast metal tube closed on one end with a tapered bore and closed on both ends by pouring the spinning mold while in an inclined position. Pouring an inclined mold is similar to pouring the mold in the horizontal position where pouring is limited to small quantities of molten metal to prevent the metal from falling back (raining) and oxidizing.

SUMMARY OF THE INVENTION

The invention is directed to a method of vertically pouring molten metal into an upended mold where all of the metal flows to the closed end of the mold. The Hybrid Centrifugal Casting Machine is near vertical when the metal is poured into the mold, slightly tilted in some degree away from vertical, to provide a mold surface to flow the molten metal into position without splashing. Pouring into a long absolutely vertical mold will cause splashing, thus aerating and oxidizing the metal. It is to be understood that the term "vertical mold" hereafter is actually slightly tilted away from vertical. This procedure will determine the pouring rate of the metal. A slow pouring rate will aid in solidifying the nose section. Therefore, pouring vertically will be pouring into a mold slightly tilted off true-vertical, but will have the pouring benefit of the vertical casting process of turbulent-free pouring. The mold can be stationary or it can be slowly rotated to generate less than one gravity of force to prevent raining. This will distribute the heat evenly and prevent the mold from warping.

The present invention is a hybrid centrifugal casting machine, which employs the physical properties of nature in both technologies of vertical and horizontal centrifugal casting processes. The method can be used for casting a tubular item of straight bore with open ends or a straight bore closed on one end (such as a bomb body). The hybrid centrifugal casting machine pivots on a trunnion mounting enabling it to pivot from a vertical position to the horizontal position.

With the mold in the vertical position, large quantities of molten metal can be poured. Molten metal contained in the mold rests against the mold wall. Centrifugal force generated by the rotating mold forces the molten metal against the mold wall with increasing pressure onto and up the surface of the mold wall. The surface of the metal forms in a paraboloidal shaped curve. The paraboloidal shape of the curve is not influenced by the difference in the specific gravity of different liquids as evident in U.S. Pat. No. RE 17,220 to Robert F. Wood.

The physical property can be explained by the following. A spot on the mold representing a spot in the molten metal moves alternately up and down cancelling out the effect of density according to the laws of rotating bodies. Therefore, the shape of the paraboloidal curve is the same for water as for molten metal. One example is a spinning gyroscope that remains stable while resting on only one end of its axle.

A trough and shaping device is used to compact and shape a refractory lining in the mold body. The device includes a crank on both ends of the trough, attached to a shaft extending through the centerline of the lining trough, which is attached to shafts supported on the centerline of the mold and an operating assembly. Rotating the shaft causes the trough to revolve in a circular path equal to the length the crank arms that hold the trough off the centerline of the mold. The trough shaft on the closed end of the mold enters a bearing pocket in the mold body for support.

A blade is mounted full length of the trough on center at the top of the trough with the first quadrant of the trough open to the trough cavity. A short shaft or pin is attached to the trough at the base of the blade and projects parallel to the centerline of the trough and into a vertical slot in a fixed plate, while the entire trough revolves about the centerline of the mold and machine. The trough does not rotate about its axis because the short shaft is fixed in the slot so that the shaft moves up and down in the slot on every revolution of the crank. The slot is fixed in the vertical position causing the blade to move toward the mold wall and then away from the mold wall each time the crank revolves about the centerline of the mold. The rotation of the trough shaft can be stopped at any angle which is desired for the blade to engage the revolving refractory material on the inner surface of the rotating mold. The blade height above the trough is adjustable to fix the thickness of the lining.

Rotating the mold in a first clockwise direction causes the flat end of the blade to form a positive angle with the refractory for packing. Rotating the mold in a counterclockwise direction causes the sharp edge of the blade to form a positive angle with the refractory causing the removal of refractory material for contouring.

Therefore, the capability to alter the angle that the flat end of the blade engages the refractory allows the use of a single combination blade having the flat end surface machined to the dimensions of the article, thus cutting the trough operating time in half.

The aspects of the invention are basically attained by providing a method for casting a metal article which comprises the steps of providing a mold body having a longitudinal axis with a hollow bore defining a mold cavity which extends axially through the body from a first open end to a second closed end of the mold body. The second end of the body has a substantially frustoconical shape which defines a surface converging toward an axial center of the mold body. The mold body is oriented in a near vertical orientation with respect to the longitudinal axis and rotates the mold about a vertical axis. A molten metal is introduced into the mold cavity while continuously rotating the mold body at a rotational speed sufficient to distribute the molten metal along the frustoconical shaped surface. The mold body is pivoted to orient the longitudinal axis of the mold body to the horizontal orientation while continuously rotating the mold body about its longitudinal axis at a rotational speed to distribute the molten metal along a length of the hollow bore. The molten metal is solidified to produce a centrifugal cast hollow metal article which has a substantially cylindrical shaped hollow body with a closed frustoconical hollow end.

The aspects of the invention are also attained by providing a centrifugal molding apparatus which comprises a hollow mold body with a mold cavity which has a first open end and a second closed end. The second end has a substantially frustoconical shaped inner surface. A support assembly supports the mold body and is capable of pivoting the mold body between a vertical orientation with respect to a longitudinal axis of the mold body and a horizontal position. A drive device rotates the mold assembly about its longitudinal axis at a rotational speed sufficient to distribute a molten metal while rotating the mold body in the horizontal position.

These and other aspects of the invention will become apparent from the following detailed description of the invention and the annexed drawings.

BRIEF DESCRIPTION OF THE DRAWINGS

The following is a brief description of the drawings, in which.

DETAILED DESCRIPTION OF THE INVENTION

The present invention is directed to a method and apparatus for molding a metal article. The invention is particularly suitable for the centrifugal casting of metal to form hollow articles that are closed on one end.

The apparatus of the invention is a centrifugal casting machine that casts the metal in a vertical orientation and a horizontal orientation. For this reason, the apparatus is referred to herein as a hybrid centrifugal casting apparatus.

The molding apparatus includes a substantially cylindrical shaped mold body having a closed bottom end. The mold body is initially oriented in the vertical position with the mold rotating about its longitudinal axis. An amount of molten metal is added to the mold cavity where centrifugal force places the molten metal into the mold wall without turbulence and the mold body is pivoted to a horizontal or inclined position to distribute the metal along the length of the mold body. When the metal cools and solidifies, the article is removed. The method of the invention enables the casting of long articles that have a closed end and side walls that are much thicker than can be obtained by the conventional horizontal casting methods. The pivoting movement and the angle of inclination of the mold body are selected to control the distribution of the molten metal and the thickness of the wall of the finished article.

The method of the invention is primarily directed to a method for the centrifugal casting of hollow metal bodies or articles having a closed end. In one embodiment, the molded article is a long hollow bomb body having a frustoconical shaped end. Although various references are made to a bomb body herein, it is to be understood that the invention is applicable to other molded articles. The invention is particularly suitable for the centrifugal casting of molten metal to form a hollow molded article having a substantially cylindrical body portion and a closed frustoconical shaped end. The molded article also has a hollow cavity extending longitudinally through the molded article.

The method and apparatus of the invention enables the thickness of the wall of the molded body to be controlled. In one embodiment, the wall of the frustoconical shaped article has a substantially uniform thickness along the length of the molded article. The method and apparatus of the invention enables the thickness of the wall of the molded article to be selectively varied along the length of the molded article. In one embodiment, the wall thickness of the frustoconical shaped end of the molded article is greater than the thickness of the cylindrical side wall of the molded article. In other embodiments, the thickness of the wall section of the frustoconical shaped portion can be thinner than the wall section of the cylindrical body.

Figure 1:
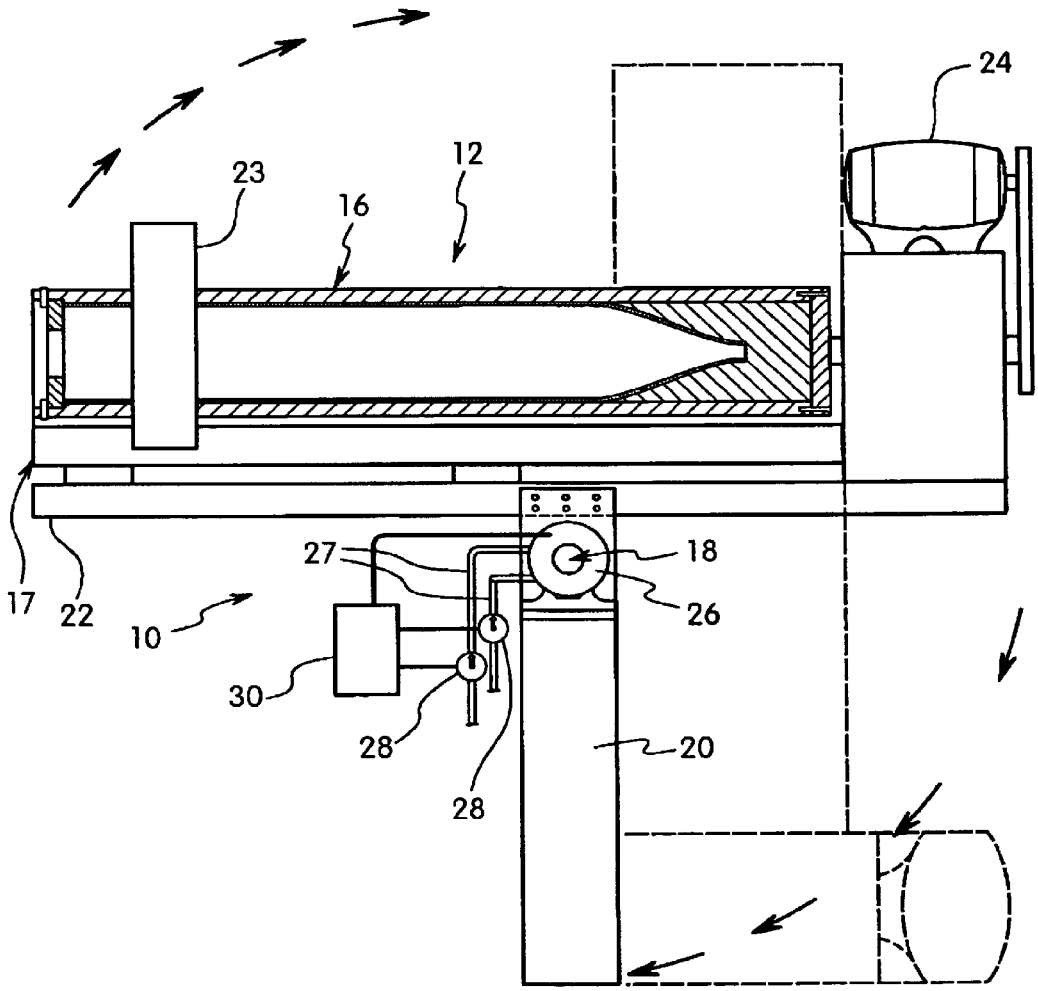
FIG. 1 is a side elevational view of the molding apparatus in one embodiment of the invention showing the molding assembly.
Figure 2:
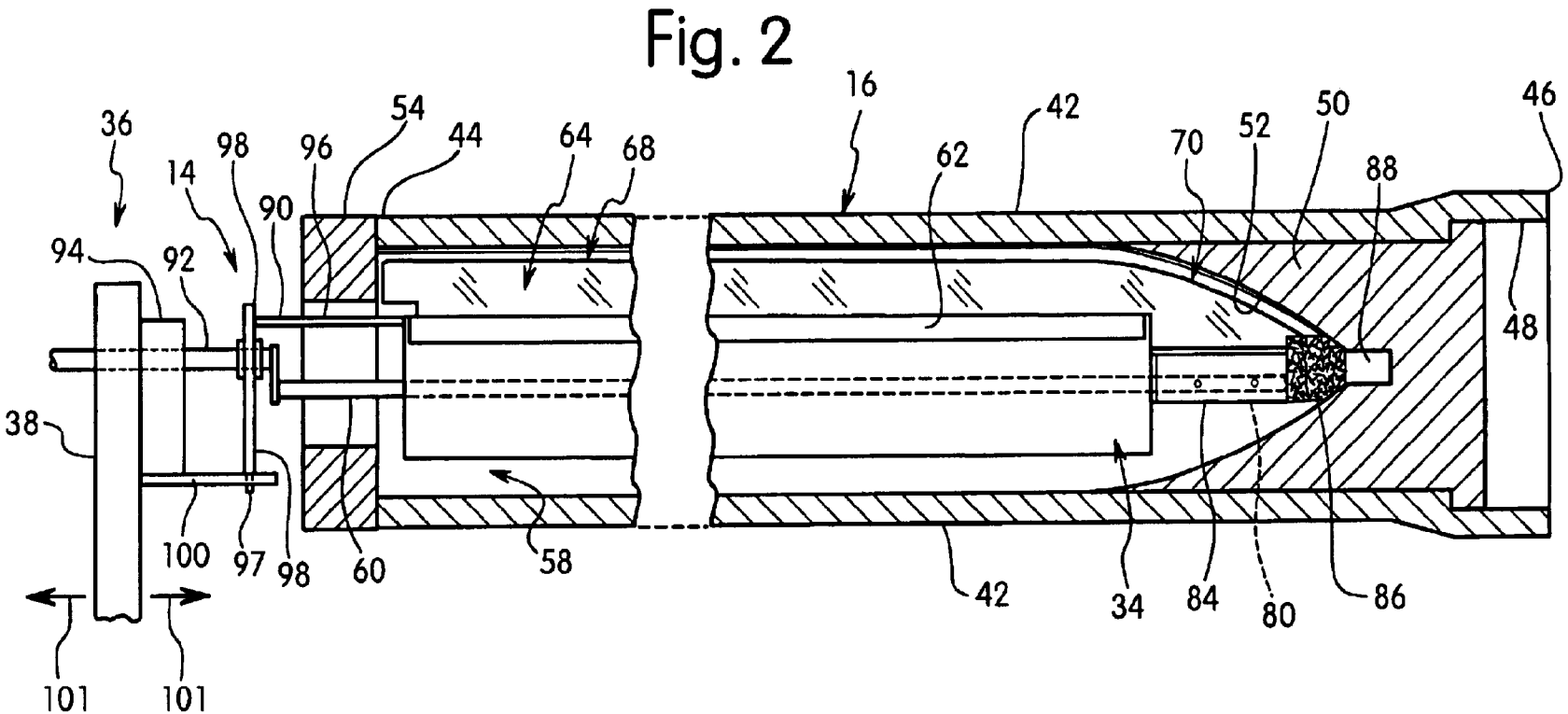
FIG. 2 is a cross-sectional side elevational view of the mold body and the mold lining contouring apparatus used in the molding assembly of FIG. 1.

Referring to the drawings, the apparatus of the invention includes a molding apparatus 10 having a mold assembly 12 as shown in FIG. 1 and a contouring apparatus 14 shown in FIG. 2. Referring to FIG. 1, mold assembly 12 includes a mold body 16 which is mounted in a casting machine 17 attached to a platform 22 with trunnions 18 in a support 20. Support 20 is mounted to the platform 22 and extends in an upward direction for supporting the mold body 16. Mold body 16 is coupled to support 20 so that mold body 16 can be pivoted about a horizontal axis defined by trunnion 18. In a preferred embodiment, mold body 16 is pivotable between a vertical orientation where the longitudinal axis of mold body 16 extends vertically and a substantially horizontal position where the longitudinal axis of mold body 16 is oriented in a vertical direction as shown in the phantom lines of FIG. 1. In other embodiments, mold body 16 can be pivoted to any desired angle with respect to support 20.

Mold assembly 12 is supported by a bearing 23 and includes a drive assembly 24 coupled to mold body 16 for rotating mold body 16 about its longitudinal axis in a manner consistent with conventional centrifugal casting devices. In the embodiment shown in FIG. 1, a single drive assembly 24 is provided, although the actual number of drive assemblies can vary depending on the needs of the apparatus. Drive assembly 24 is capable of rotating mold body 16 at selected speeds suitable for centrifugal casting of molten metal.

Mold body 16 is rotated about the trunnions 18 by a hydraulic motor 26. Hydraulic motor 26 is capable of pivoting mold body 16 from a vertical, upright position to an inclined or horizontal position and then returning the mold body 16 to the vertical position. Motor 26 is a hydraulic motor that is operatively connected to a power source through lines 27 having pressure gauges 28. Motor 26 is connected to a suitable operating assembly or computer 30 for controlling the timing and movement of mold assembly 12. In a preferred embodiment, drive assembly 24 and motor 26 are connected to an operating computer 30 to coordinate the rotational speed of mold body 16 and the pivoting movement of mold body 16 between the vertical and horizontal positions. Drive assembly 24 is capable of continuously rotating mold body 16 at selected speeds while mold body 16 is being pivoted between the vertical and horizontal positions.

As discussed hereinafter in greater detail, the method of the invention introduces a molten metal into a near vertical mold body 16 and at a selected time thereafter pivots mold body 16 to the horizontal position during the molding step. The pressure gauges 28 are provided to monitor the weight distribution of the molten metal within the mold body 16 during the molding step. Pressure gauges calibrated to read in pounds are preferably operatively connected to the operating computer and send a signal to the computer 30 indicating the weight distribution of the molten metal within the mold body 16. The operating computer can then actuate motor 26 to pivot mold body 16 to a desired angle to provide the desired weight distribution of the molten metal within the mold body 16. In other embodiments, the operating computer 30 can actuate hydraulic motor 26 to provide a rocking motion to mold body 16 to cause the molten metal to flow back and forth along the longitudinal length of mold body 16 to distribute the molten metal and assist in solidifying the molten metal to form the molded article. The rocking motion provided to the mold body 16 can be desirable when thick walls are to be molded on a contoured longitudinal mold wall surface.

Referring to FIG. 2, contouring assembly 14 is constructed to be inserted into mold body 16 to distribute, compact and shape a mold lining within mold body 16. Contouring assembly 14 includes a trough 34 connected to an operating assembly 36, which is in turn connected to a support 38. Support 38 is connected to a platform and is movable in a linear direction toward mold assembly 12 to insert trough 34 into mold body 16.

Referring to FIG. 2, mold body 16 in one embodiment of the invention has a cylindrical side wall having a first open end 44 (not shown) and a second open end 46. Second end 46 includes a flange 48 receiving an end block 50. Block 50 has a dimension to be received within second end 46 to close second end 46 of mold body 16. Block 50 can be made of any suitable material for casting molten metals. In one embodiment, block 50 is made from carbon. Block 50 has an end face 52 corresponding to the desired shape of the resulting molded article. In preferred embodiments of the invention, the molded article has a frustoconical shaped end. Thus, in the embodiment illustrated, end face 52 of block 50 has a frustoconical shaped concave recess defining end face 52.

First end 44 of side wall 42 includes an end cap 54 having an axial opening 56 having a dimension to enable trough 34 to move in and out of mold body 16. End cap 54 is removably coupled to side wall 42 by screws, bolts or other fasteners as known in the art. Side wall 42, end cap 54 and end block 50 define a mold cavity 58.

Figure 3:
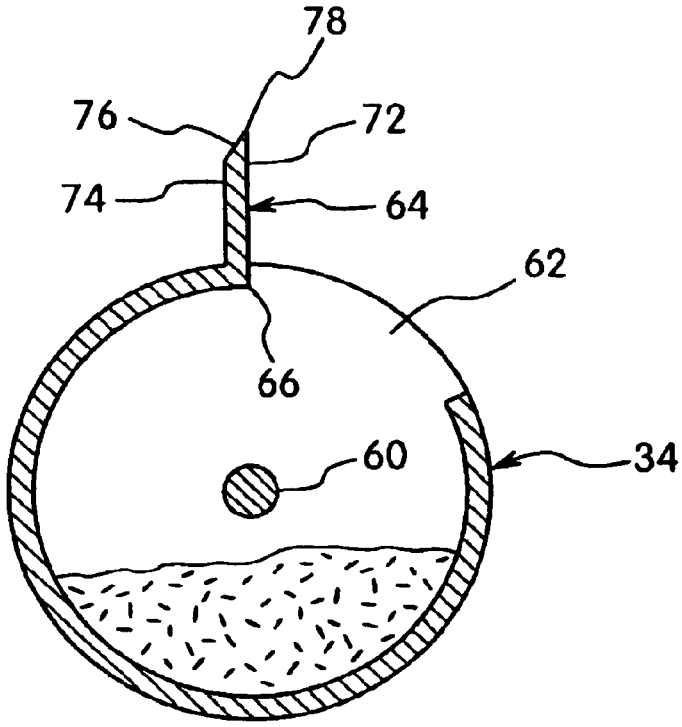
FIG. 3 is a cross-sectional end view of the trough showing the compacting and contouring blade.

Referring to FIG. 2, contouring assembly 14 includes trough 34 having a substantially cylindrical cross-section and a length corresponding substantially to the length of the longitudinal dimension of mold cavity 58. Trough 34 is supported by a center rod 60 extending axially through the center of trough 34 as shown in FIG. 2. The end walls of trough 34 are coupled to center rod 60 to prevent relative rotation between trough 34 and center rod 60. Trough 34 also includes an opening 62 extending the longitudinal length of trough 34 and having a dimension to dispense and collect the refractory lining material as discussed in detail below. A compacting and contouring blade 64 is connected to trough 34 and extends the longitudinal length of trough 34. Blade 64 is positioned along one edge of opening 62 as shown in FIG. 2 and FIG. 3. Preferably, blade 64 has an edge 68 having a shape and length corresponding to the desired longitudinal shape and dimension of the resulting molded article. In the embodiment illustrated, mold assembly 12 is constructed to mold a bomb body having a closed end so that blade 64 has a straight longitudinal edge 68 extending along side wall 42 of mold body 16 and a curved end portion 70 complementing the curvature of end face 52 of block 50.

Figure 4:
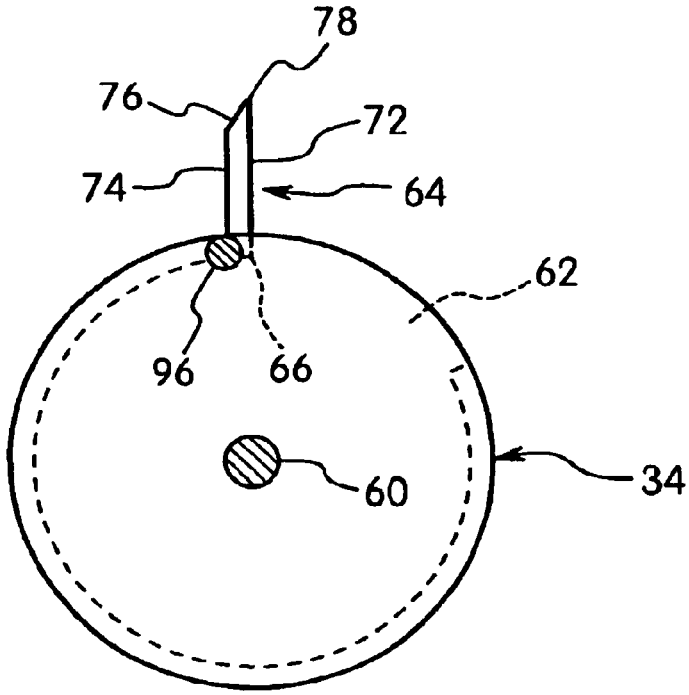
FIG. 4 is an end view of the trough and compacting and contouring blade.

Referring to FIGS. 3 and 4, blade 64 has a first leading face 72, a second trailing face 74 and an outer edge 76. Outer edge 76 is inclined with respect to the leading and trailing faces of blade 64. In a preferred embodiment, outer edge 76 forms a sharp pointed edge 78 capable of shaping and contouring a refractory material and directing the refractory material into trough 34. In one embodiment, blade 64 is adjustable to select the radial dimension of the blade with respect to the trough. For example, blade 64 can be attached by screws that can be used to adjust the position of the blade on the trough. The position of the blade determines the thickness of the mold lining as discussed herein. Typically, blade 64 has a width of about 2 inches in the radial dimension and a thickness of about ¼ inch. Outer edge 76 has a width of at least ¼ inch to provide a surface that is able to plow and compact the refractory particles when the blade 64 contacts the loose layer of particles.

Referring to FIG. 2, center rod 60 extends through trough 34 and has a forward end 80 and a rear end 82. Forward end 80 is connected to a linkage 84 having a pinion 86 oriented parallel to the longitudinal axis of center rod 60. As shown in FIG. 2, pinion 86 on linkage 84 is oriented with its center axis spaced radially from the center axis of center rod 60. Pinion 86 is coupled through a bearing to a bushing 88 or support member that is inserted into a recess in block 50. Bushing 88 enables mold body 16 to rotate while supporting pinion 86 in the axial center of mold body 16.

Rear end 82 of center rod 60 is connected to a linkage 90 in the form of a crank arm which is connected to a shaft 92. Shaft 92 is connected to operating assembly 36 which includes a motor 94 capable of rotating shaft 92 about its axis. Shaft 92 is coaxially aligned with the center axis of mold body 16 and bushing 88. The length of linkage 90 is the same length as linkage 84.

Figure 2A:
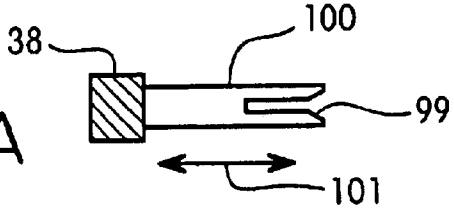
FIG. 2A is a top view of the support for the contouring apparatus.
Figure 5:
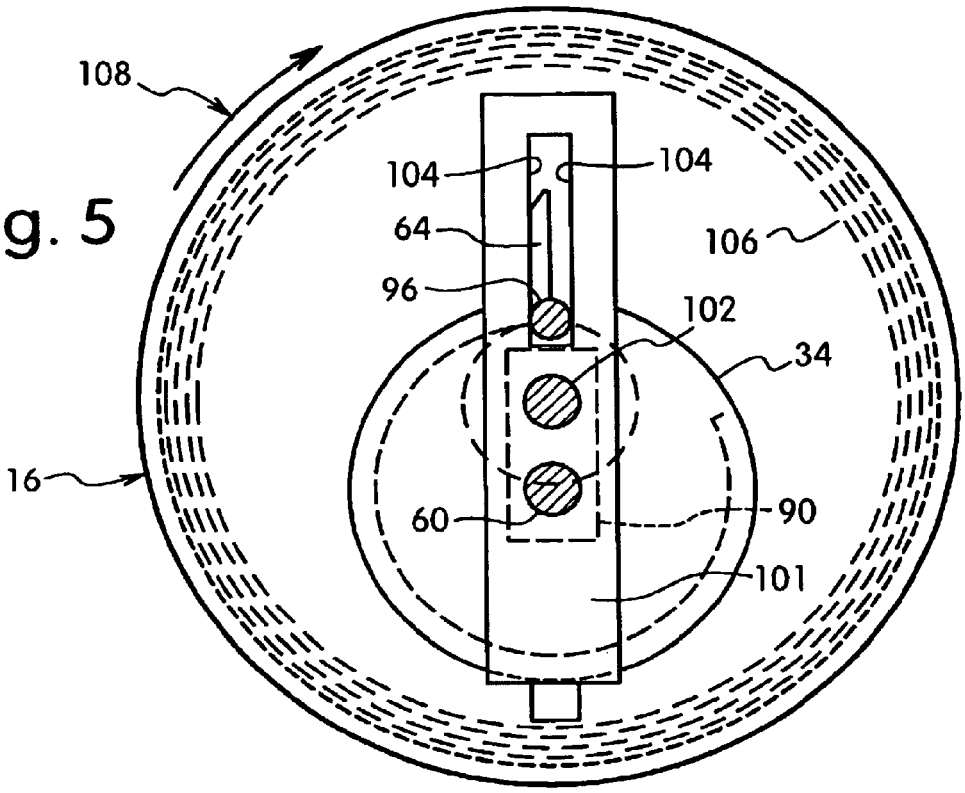
FIG. 5 is an end view showing the position of the blade in the rotating mold in the initial position.

A rod 96 is connected to the rear end face of trough 34 as shown in FIGS. 2 and 4. One end of rod 96 is coupled to the peripheral edge of trough 34 adjacent blade 64 as shown in FIG. 4. Rod 96 extends parallel to center rod 60 and is connected to a support plate 98. Support 98 has a substantially rectangular configuration in the embodiment illustrated and is connected to a base 100 as shown in FIG. 2. Base 100 is fixed to operating assembly 36. Base 100 can selectively engage and with disengage a pin 97 that slides in a slot 99 in base 100 by moving in the direction of the arrows 101 in FIG. 2 and FIG. 2A. In the position shown in FIG. 2, base 100 engages support 98 to fix the position of support 98 with respect to base 100. Base 100 can be selectively disengaged so that support 98 can rotate about shaft 92 as discussed hereinafter. Referring to FIGS. 2 and 5, support 98 includes an aperture 102 receiving shaft 92 and allowing shaft 92 to rotate within aperture 102. Support 98 also includes an elongated slot 104 which receives the end of rod 96 so that rod 96 is able to reciprocate within the longitudinal length of slot 104. As discussed hereinafter in greater detail, shaft 92 is rotated which causes center rod 60 to rotate in a circle around the center axis of shaft 92 and the center axis of mold body 16. Support 98 is normally in a fixed position so that rod 96 and the edge of trough 34 that is coupled to rod 96 reciprocate in a substantially linear direction with respect to shaft 92. The rotation of shaft 92 moves blade 64 toward and away from the inner surface of mold body 16 and orients the edge of blade 64 at various angular positions with respect to the inner surface of mold body 16 depending on the angular orientation of linkage 82.

In preferred embodiments of the invention, mold body 16 has a mold cavity 58 with a shape and dimension corresponding to the desired shape and dimensions of the resulting molded article. A mold lining from a dry binderless refractory material is formed on the inner surface of the mold body 16 on which the molten metal is cast. According to the method of the invention in one embodiment, mold body 16 is mounted in mold assembly 12 with the center axis of mold body 16 oriented horizontally as shown in FIG. 1. The trough 34 with contouring apparatus 14 containing the refractory material is inserted into horizontal mold body 16 through opening 56 in end cap 54 until bushing 88 seats in the complementing recess in end block 50 as shown in FIG. 2. The refractory-filled trough of the contouring apparatus 14 is inserted into the horizontal mold body. Shaft 92 of contouring apparatus 14 is rotated to position trough 34 so that blade 64 is spaced from the mold wall as shown in FIG. 5.

As shown in FIG. 2, curved end portion 70 of blade 64 extends from trough 34 so that only curved end portion 70 can penetrate the nose section defined by block 50. Once contouring apparatus 14 is position in mold 16, mold 16 is tilted to about 30° nose-down and a measured quantity of loose refractory particles for lining the nose section is introduced from a handheld scoop into the body section of mold 16. The refractory particles fall to the closed end of the nose section of mold body 16 by the action of the slowly turning mold 16 in a clockwise direction, oriented at an incline of about 30° nose-down.

Figure 6:
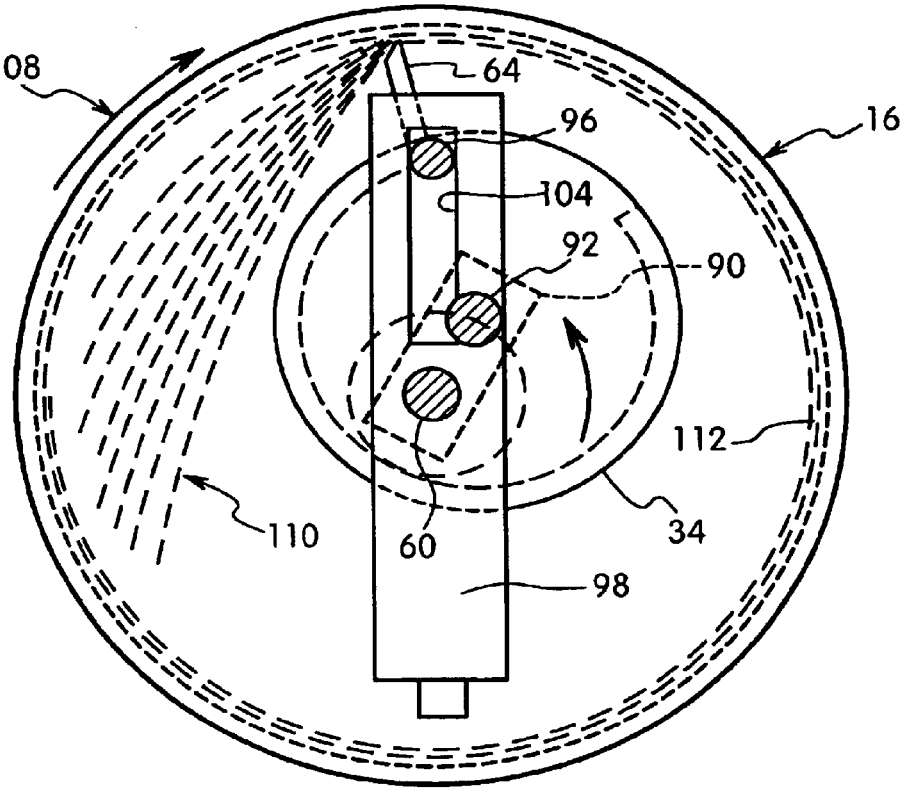
FIG. 6 is an end view showing the refractory material being compacted.
Figure 7:
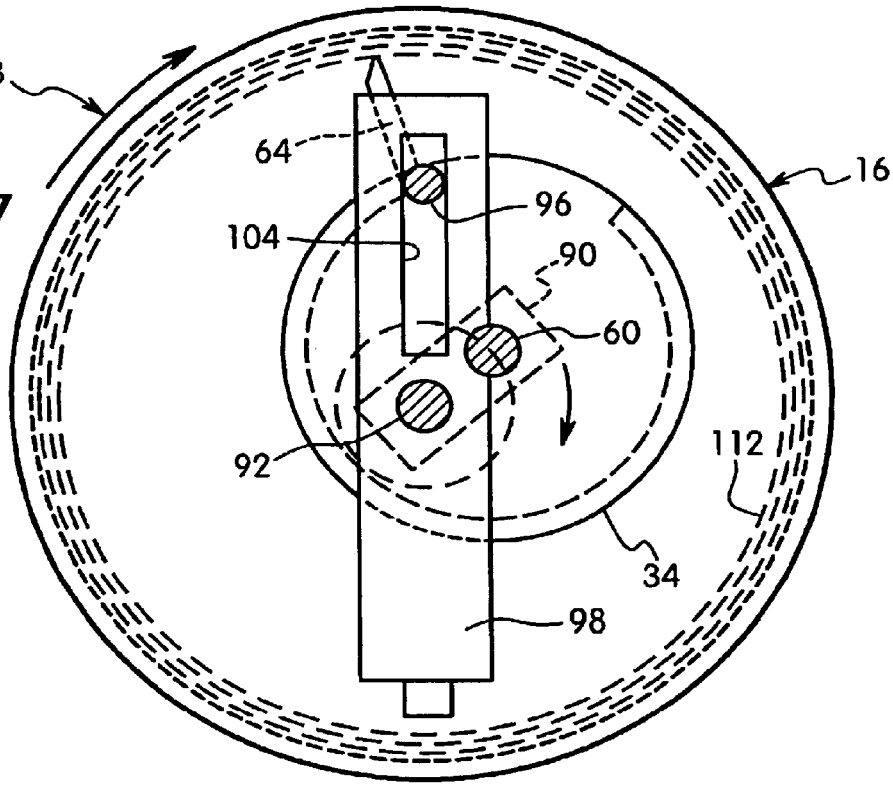
FIG. 7 is an end view showing the blade being moved away from the compacted refractory material.

While rotating mold body 16 to distribute the refractory particles, mold body 16 is then pivoted to an angle of about 10° nose up. The angle of mold body 16 can be varied depending on the desired shape of the lining and the distribution of the refractory particles. RPM is increased to lining speed rotating mold body 16 in a clockwise direction as indicated by arrow 108 in FIGS. 5 and 6. Support 100 is then actuated to release and disengage plate 98 from support 100. Shaft 92 is rotated clockwise which allows plate 98, trough 34 and blade 64 to rotate simultaneously about the axis of shaft 92. Shaft 92 is rotated to invert trough 34 thereby dispensing the refractory particles into mold body 16. Shaft 92 is again rotated to rotate plate 98 back into engagement with support 100 thereby fixing the position of plate 98 and orienting trough 34 and blade 64 in the position shown in FIG. 5. Shaft 92 is rotated in a counterclockwise direction to move flat outer edge 76 of blade 64 toward the loose refractory particle 112. Blade 64 is gradually moved into contact with the refractory particles to redistribute, compact and densify the entire lining layer of refractory particles as shown in FIG. 6. Because only the curved end portion 70 of blade 64 extends into the nose section of mold 16, allows the 10 degree incline to displace and redistribute the refractory over the entire nose section of mold 16 with the excess refractory displaced into the body section of mold 16. Shaft 92 is then slowly rotated clockwise to withdraw blade 64 away from the mold wall to pack and densify the redistributed refractory particles to form a compacted, densified, hard and homogeneous mold lining as shown in FIG. 7. Mold 16 is returned to the horizontal position. Trough 34 and blade 64 are then returned to the original position shown in FIG. 5.

Trough 34 is initially positioned in the rotating mold body 16 as shown in FIG. 2. Initially, shaft 92 is rotated to a position to orient trough 34 and to position blade 64 away from the inner surface of mold body 16. This position is generally shown in FIG. 5. The refractory material is distributed around the inner surface of mold body 16 to form a loose layer 106 of refractory particles that are held in place by the centrifugal force produced by the rotation of mold body 16. Positioning the mold body in the inclined position of about 30 degrees nose down while introducing the refractory material from a hand held scoop enables the refractory material to fall to the closed bottom end of the mold body by the action of the slowly turning mold 16.

The loose layer of refractory material 112 is compacted and densified to form a compact, air impervious layer. To form the compact layer, shaft 92 is rotated which rotates linkage 90 to move the position of trough 34 with respect to mold body 16. In the illustrated embodiment, mold assembly 16 is rotated in a first direction indicated by arrow 108 shown in FIG. 6. Shaft 92 is rotated in a counterclockwise direction in the illustrated embodiment to pivot linkage 90 to the position shown in FIG. 6. It will be understood that the same compacting effect is obtained by rotating the shaft in a clockwise direction. As shown in FIG. 6, blade 64 has moved closer to the inner surface of the mold assembly and the angular orientation of blade 64 with respect to the mold assembly has decreased. As shaft 92 is rotated further in the counterclockwise direction to the position shown in FIG. 6, trough 34 and blade 64 have moved into position to contact the loose layer of refractory material 112. As shown in FIG. 6, the inclined outer edge 76 of blade 64 contacts the layer 112 of refractory material at an angle to plow and compress the refractory particles mechanically into the inner surface of mold body 16. Outer edge 76 and blade 64 have dimensions to plow and compact the refractory material.

A portion of the particles of the refractory material are deflected away from the loose layer 112 indicated by deflected particles 110 which are directed back against the rotating surface of mold body 16. Shaft 92 is rotated to cause the blade 64 to penetrate into the loose layer 112 to compact the lowermost portion of layer 112 against the inner surface of mold body 16 by the angle of the blade 64 with respect to the mold surface.

Shaft 92 in one embodiment of the invention is then rotated in a clockwise direction to gradually move the inclined outer edge 76 of blade 64 away from the inner surface of mold body 16. Alternatively, shaft 92 can be rotated in the same direction to move the blade completely away from the mold surface. The gradual movement of blade 64 away from the inner surface of mold body 16 causes the refractory material to be plowed, redistributed and mechanically compressed against the inner surface of the mold body 16 by the angle and width of blade 64, cause the thickness of the compacted layer to increase and to form a hard compact and air impervious layer of inner locking particles indicated by layer 112 in FIG. 7. Shaft 92 is rotated until blade 64 no longer contacts the compacted layer 112 of refractory particles.

Figure 8:
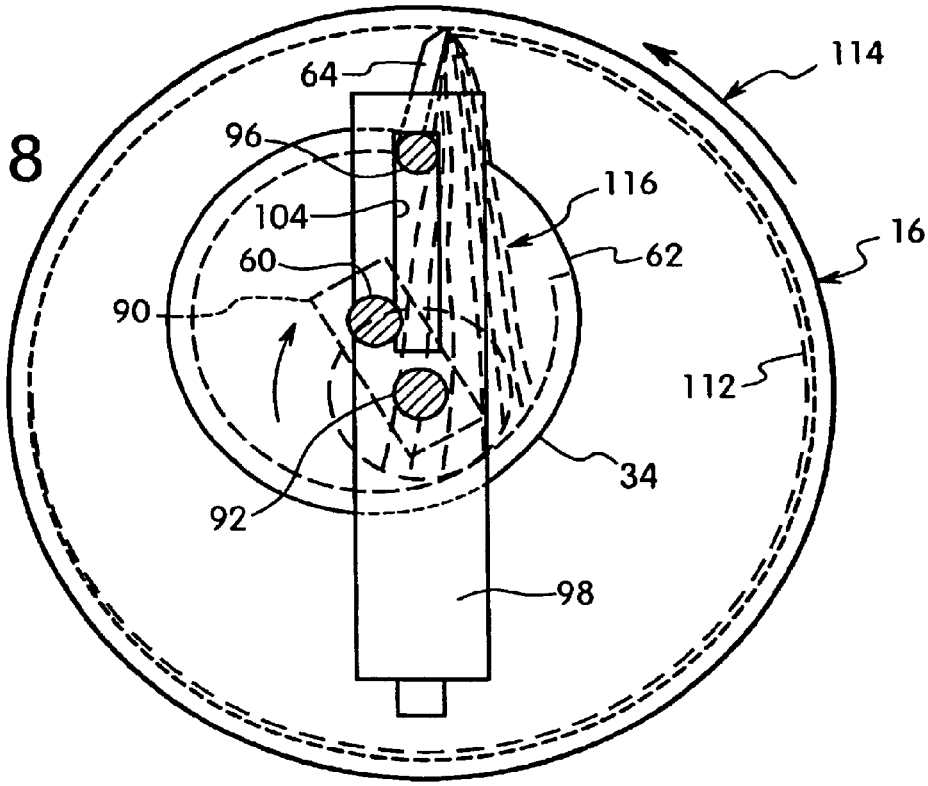
FIG. 8 is an end view showing the blade shaping the compacted refractory material.
Figure 9:
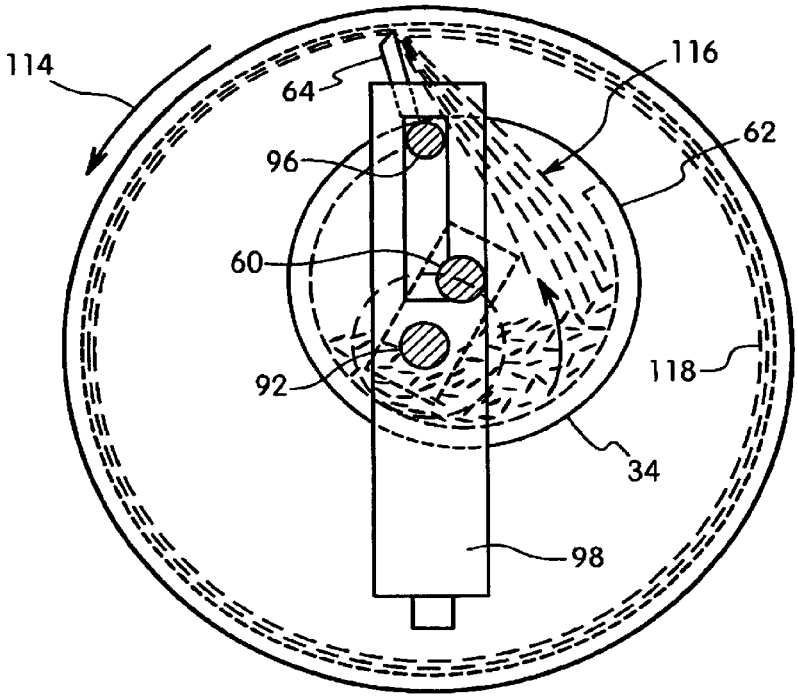
FIG. 9 is a schematic view showing the compacting and shaping of the refractory layer using only the sharp edge and leading face of the blade.

After the compacted layer 112 of refractory particles has been formed, the direction of rotation of mold body 16 is reversed as indicated by arrow 114 in FIG. 8. Shaft 92 in this embodiment is rotated in a clockwise direction. As shown in FIG. 8, the rotation of the shaft moves the sharp edge 78 of blade 64 into contact with compacted layer 112. Sharp edge 78 of blade 64 is gradually moved into contact with the rotating compacted layer 112 to shave and cut excess particles from compacted layer 112 to form the final desired shape and dimension of the resulting mold lining. The refractory particles removed from compacted layer 112 by the sharp edge 78 indicated as 116 are deflected into the open slot 62 of trough 34 where particles 116 are collected and can be removed from mold body 16. Once the desired shape of the compacted mold lining is obtained, shaft 92 is rotated to retract blade 64 away from the resulting mold lining as shown in FIG. 9. At this stage, trough 34 is removed from mold cavity 58.

Large grain (60 mesh) dry binderless refractory material, used for conduction of heat and for venting, applied to a spinning centrifugal casting mold by the process of U.S. Pat. No. 4,632,168 does not always lock into place sufficiently to allow stopping mold 16 for changing the direction of rotation from packing to contouring operations.

The large grain refractory can be distributed, packed and contoured when mold 16 is rotated counterclockwise. Shaft 92 can be rotated counterclockwise to move trough 34 and blade 64 to position its sharp edge 78 to enter the rotating refractory gains 118 at a negative angle as shown in FIG. 9. The negative angle of blade 64 and its sharp edge 78 applies pressure on the refractory lining for packing as well as contours the refractory to the shape of the casting being produced by the shearing action of sharp edge 78.

The packing pressure is generated by the kinetic energy from the rotating refractory contacting the leading face 72 of blade 64, position at a negative angle to the refractory lining. The leading face 72 of blade 64 deflects the revolving refractory grains toward the mold wall applying packing pressure on the lining and rebounding particle 116 into opening 62 in trough 34 for removal from the mold.

Figure 10:
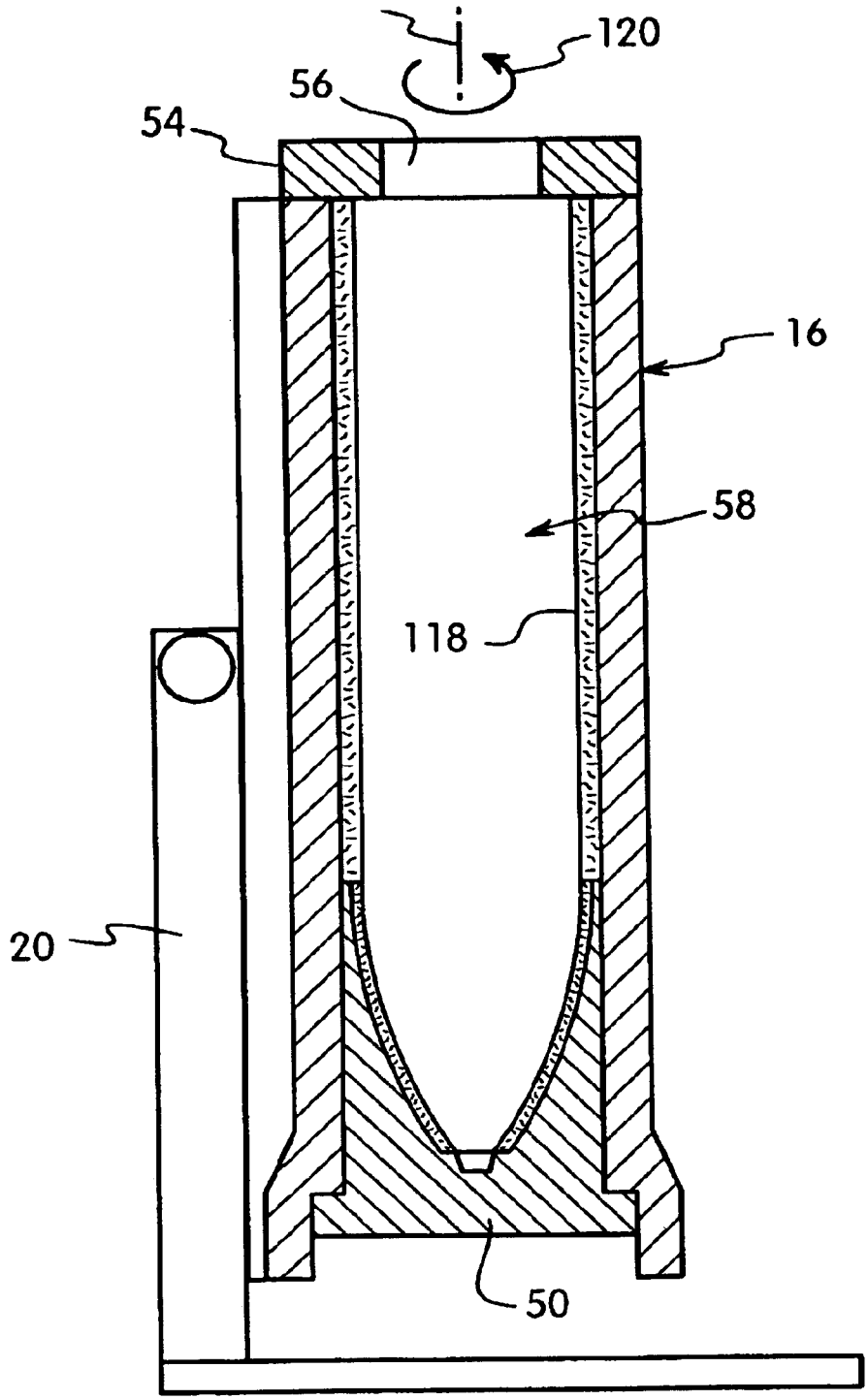
FIG. 10 is a partial side view in cross-section of the mold body in the initial position for molding the article.
Figure 11:
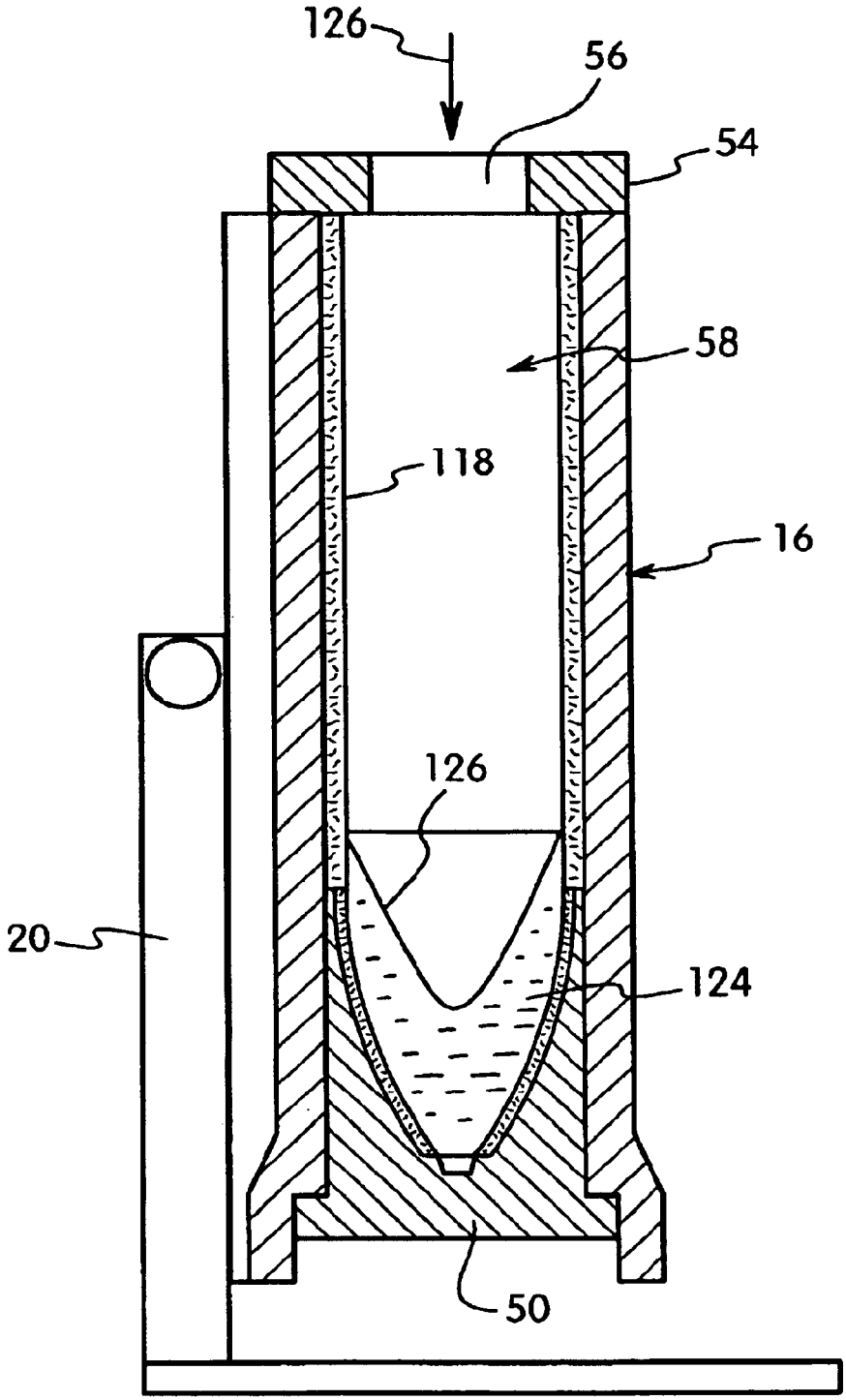
FIG. 11 is a cross-sectional side view showing the molding body containing a molten metal.

The resulting mold body 16 shown in FIG. 10 has a substantially continuous mold lining 118 formed from the compacted layer of refractory particles. The molding lining has a profile and thickness that is determined by the shape and dimensions of the blade 64. Mold body 16 is oriented in the upright position shown in FIG. 10 with the open end facing upward and the closed end positioned downward. Mold body 16 is then rotated about its longitudinal axis indicated by arrow 120. An amount of molten metal is introduced into mold cavity 58 while continuously rotating mold body 16. Referring to FIG. 11, rotation of mold body 16 while introducing the molten metal through the opening indicated by arrow 122 causes the molten metal 124 to form a parabolic shape indicated by arrow 126 against the frustoconical shaped recess in block 50. In one embodiment, the amount of molten metal 124 introduced at this stage into mold body 16 is sufficient to mold the entire finished article. In alternative embodiments, the molten metal can be continuously, slowly added. At this stage, at least a portion of the molten metal 124 begins to solidify against the mold surface defined by block 50 while the remaining portion remains fluid.

Figure 12:
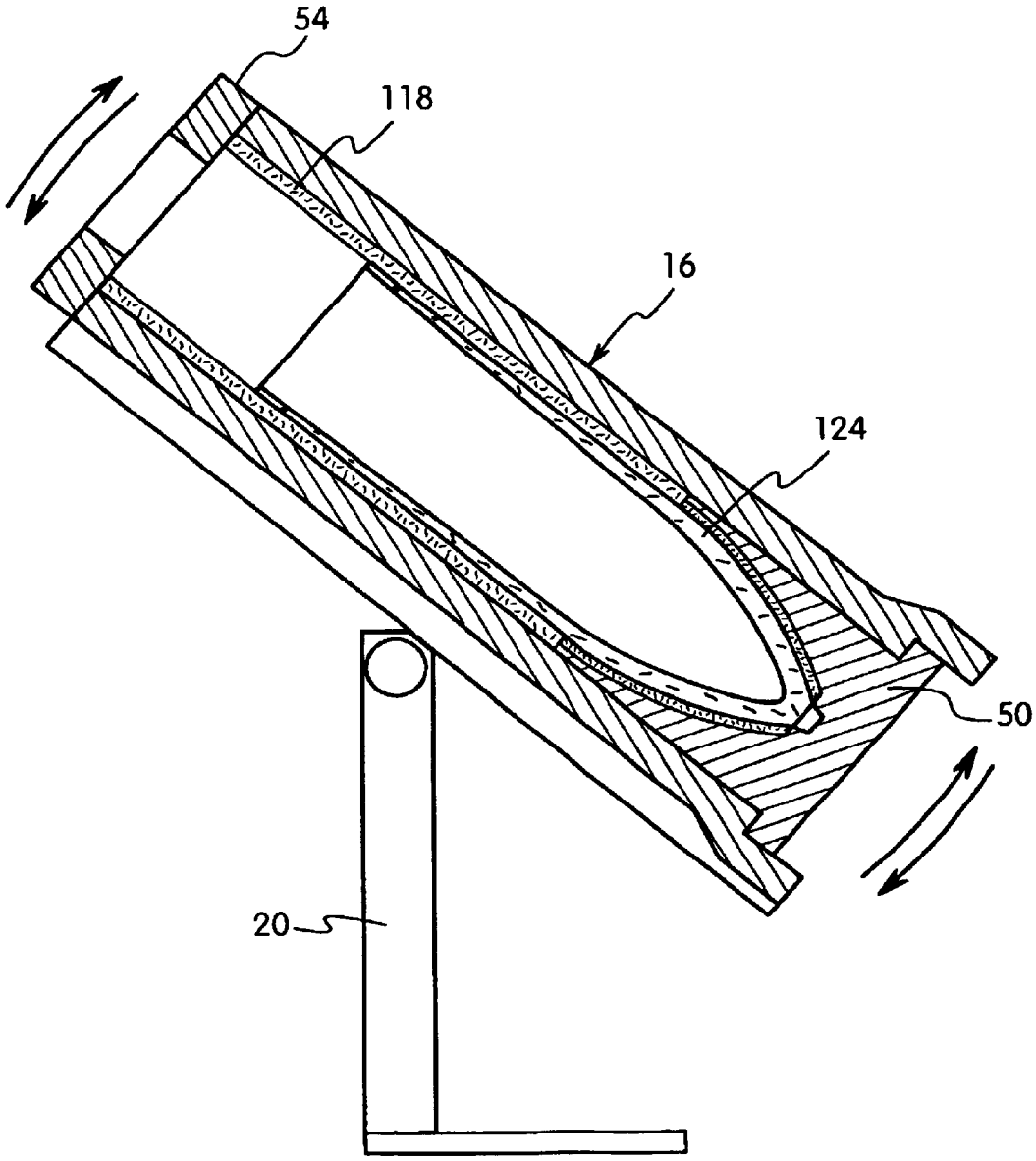
FIG. 12 is a cross-sectional side view showing the mold body at an incline.
Figure 13:
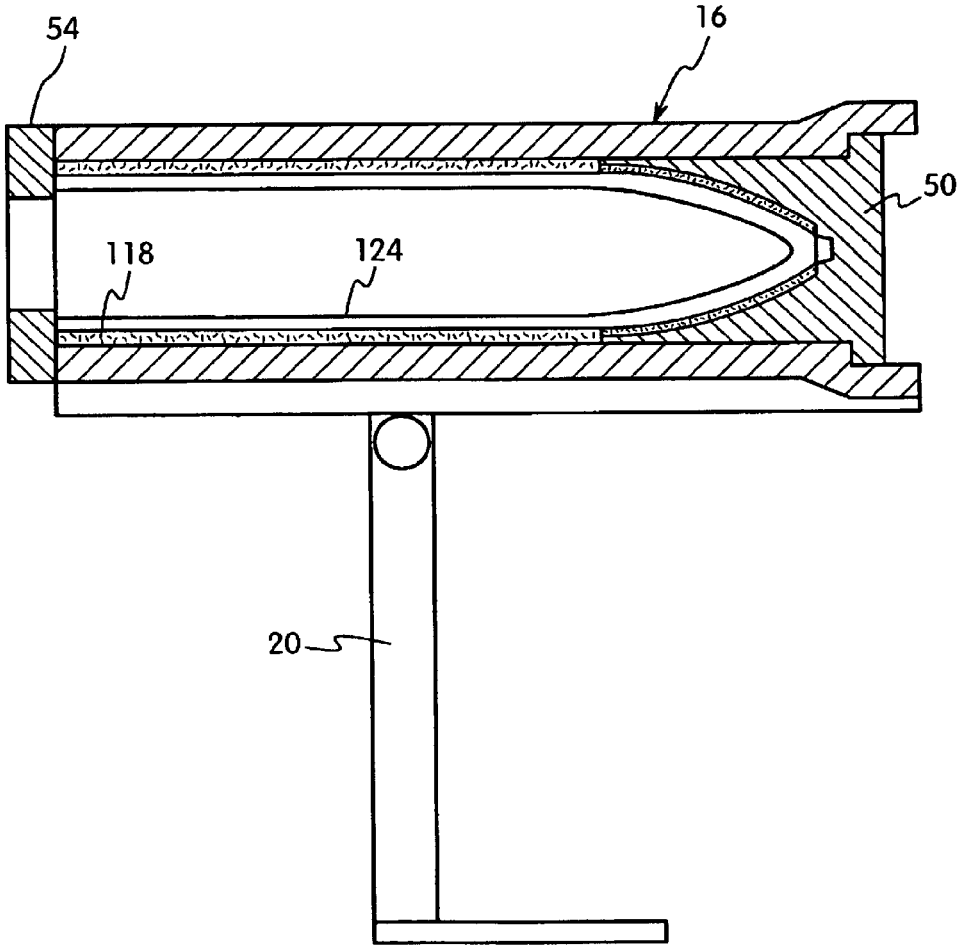
FIG. 13 is a cross-sectional side view showing the molding body in the horizontal position for molding the article.

The rotational speed of mold body 16 is selected to provide the desired distribution of the molten metal and the parabolic shape within the rotating mold body. Mold body 16 is then pivoted about trunnion 18 to gradually position mold body 16 at an incline as shown in FIG. 12. As the angle of inclination of mold body 16 is decreased, molten metal 124 flows along the axial length of mold body 16 and is distributed around the mold body 16. Preferably, mold body 16 is continuously pivoted about trunnion 18 to orient mold body 16 in the horizontal position shown in FIG. 13. The rotation of mold body 16 distributes the molten metal along the entire length of the mold cavity as shown in FIG. 13. Mold body 16 is continuously rotated until the molten metal solidifies to form the molded article. The rotation of the mold body is then stopped and the molded article is removed from the mold body. The resulting molded article is then machined or processed further as desired.

In one embodiment of the invention, the wall thickness of the resulting molded article is substantially uniform throughout the axial length of the molded article. The thickness of the wall of the molded article in various locations along the axial length of the molded article is controlled by the rotational speed of the mold body and the timing and speed of pivoting the mold body from the vertical to the horizontal position. Where it is desired to have the thickness of the wall in the frustoconical shaped portion of the molded article thicker than the thickness of the cylindrical side wall, mold body 16 is rotated in the vertical orientation for a longer period of time to allow a larger amount of the molten metal to solidify against the frustoconical shaped portion of the mold cavity. Since the remaining amount of molten metal will be inherently less, pivoting mold body 16 to the horizontal position will then result in a thinner cylindrical wall. Conversely, rotating mold body 16 in the vertical position for a short period of time will allow a thinner layer of the solidified metal to form on the frustoconical shaped portion of the mold cavity, thereby allowing a larger amount of the molten metal to flow and form the cylindrical side walls of the molded article when the mold body 16 is pivoted to the horizontal position. Therefore, a thick wall straight bore cylindrical tube can be cast in one pour by this method. By quickly pouring all of the molten metal into a near vertical mold to flow the metal onto the mold wall surface to prevent splashing, rotating at a speed to general 100 gravities of force to quickly place all of the metal on the mold wall before transitioning the mold to the horizontal position. The timing and rate of the pivoting movement of mold body 16 is preferably controlled by a suitable computer programmed controller, such as operating computer 30, to form the molded article having the desired wall thickness.

In one embodiment, an even and uniform thickness of the wall of the straight bore cylindrical tube with a greater thickness than can be obtained than by conventional molding techniques. Large quantities of molten metal in the mold body 16 require longer cooling times to solidify the molten metal. To prevent oxidation of the molten metal while cooling, the open end of mold body 16 can be quickly closed with an insulated end plate cap. Closing the open end of mold body 16 stops the convection air currents which can cool and oxidize the metal surface. The interior of the mold cavity can also be purged with a non-reactive gas to prevent oxidation of the molten metal. In one embodiment, operating computer 30 actuates motors 26 to produce a rocking motion to mold body 16 to allow the molten metal to flow back and forth along the axial length of the inner surface of mold body 16 to distribute the molten metal and aide in uniform cooling and solidification. Exposing the molten metal to the cooling effect of the mold surface by the rocking motion can produce a uniform layer of the solidified metal on a contoured longitudinal mold surface or produce areas with a greater thickness depending on the speed and timing of the rocking motion. The depth of the solidification of the metal in the resulting molded article is a function of the heat transfer rate through the wall of the mold and the time allowed for cooling of the molten metal. The distribution of the molten metal in mold body 16 can be monitored by the weight detecting units 28 on the support 20 which are connected to operating computer 30. Operating computer 30 is able to monitor the weight distribution of the metal in the mold body and actuate motor 26 to orient mold body 16 in the desired angle to distribute the molten metal as desired. The final inside wall contour and thickness in the bomb body will be machined. The inside surface and dimensions of a straight bore thick wall tube is controlled by the weight and therefore the volume of the metal.

The method of the invention basically applies an amount of a dry, binderless particulate milled refractory material into a rotating mold body where the refractory material is dispersed along the inner surface of the mold body to form an initial layer. The layer is a loosely packed layer formed by centrifugal force in the rotating mold body. The layer of the refractory material is then subjected to a mechanical redistribution of the particles while the mold is continuously rotated in a manner to compact the particles and to expel air from the spaces between the particles to form a firm and substantially air impervious lining. A bar blade penetrates the initial layer of the refractory material while the mold body rotates to redistribute and compact the particles substantially along the entire length of the mold body. The blade is moved toward the inner surface of the rotating mold to penetrate the loose layer of refractory particles to a desired depth. The blade has a working surface to plow and compact the particles and form a compacted layer.

The blade is gradually moved away from the inner surface of the mold, which gradually increases the thickness of the compacted layer of particles. The resulting lining is formed from a matrix of interlocking particles of refractory material where the voids between the particles are not interconnected with an adjacent void. The voids between the particles are sealed by the interlocking particles to form a stable, air impervious and self-supporting mold lining held in place by atmospheric pressure and centrifugal force. The air impervious matrix surrounding the voids substantially prevents air from entering the voids, which further stabilizes the matrix. When the mold is rotating to generate 100 gravities, zircon flour is held in place with an additional 16 pounds of centrifugal force per cubic inch of zircon refractory material.

In the method of the invention, a compacted mold lining is formed on inner surface of the mold body to define the shape of the molded article. The mold lining is formed from dry, binderless particulate refractory material suitable for use in molding metal articles. In preferred embodiments, the refractory lining material is a zircon flour. The zircon flour is produced from a milled zircon sand in a crushing and grinding operation. The milling process crushes the large, round grains of the zircon sand into small angular shaped particles of zircon flour. Preferably, the zircon flour is milled to a particle size such that about 80% by weight pass through a 400 mesh screen and has a particle size of about 38 microns or less. It is desirable to have the particles of the refractory material milled to small angular shaped particles. The small angular shaped particles enable the particles to interlock together when compacted and the small voids between the particles not being interconnected. The interlocking particles produce a substantially air impervious layer. Small voids formed in the layer are isolated from one another surrounded by an air impervious matrix of interlocking particles. The refractory material and other methods of compacting and shaping the refractory material are disclosed in U.S. Pat. Nos. 4,124,056, 4,632,168 and 6,554,054, which are hereby incorporated by reference in their entirety.

In the method of the invention, an amount of the milled refractory material is placed in the mold body. Generally, about 150% by weight of the expected amount of the refractory material needed to form the mold lining is added to the mold body. The thickness of the mold lining can vary depending on the thickness and shape of the article being molded. In one embodiment, the mold body is positioned on drive rollers for rotating the mold body at a rotating speed suitable for centrifugal casting as known in the art. The speed of rotation will vary depending on the dimensions of the mold body and the article being molded. Preferably, the mold body is rotated at a speed to enable the particles of refractory material to adhere to the inner surface by centrifugal force and withstand erosion by the casting metal.

The density and degree of compaction of the particles forming compacted layer depend in part on the rotational speed of the mold body, the width of outer edge of the compacting tool and the angle at which outer edge contacts the particles. It has been found that rotating the mold body at a speed to produce 50 to 100 gravities within the mold combined with the plowing action of the compacting tool to move and redistribute the particles to form a compacted layer that is substantially impervious to air and has a density that is greater than that obtained by centrifugal force alone.

The dense packing of the refractory particles eliminates excess air from the lining. The resulting compacted layer is formed from interlocked particles with small voids between the particles being separated from each other so that the air in the voids is not interconnected. The small voids are surrounded by interlocking particles that form an air impervious layer around the voids. The angular shape of the refractory particles enable the particles to interlock and seal to form a stable, self-supporting matrix when the particles are physically compacted by the compacting tool.

It has been found that the packing process employing the inertia of rotation combined with centrifugal force produced by the rotation of the mold with the movement of the particle during redistribution is able to densify the particles, but centrifugal force by itself does not compact the particles to cause the particles to interlock. It has been found that packed particles of zircon are interlocked and form a stable molding lining with substantially no soft areas that can retain its shape after the mold body is stopped. The air impervious matrix of interlocking particles substantially prevents air from entering the voids, which prevents the particles from moving, because of atmospheric pressure. The sealed voids produce a suction-like effect, which retains the particles in place. If the particles surrounding the void are compacted by physical force decreasing the volume of the void, a partial vacuum is created. Air cannot enter the void and eliminate the partial vacuum, because the thousands of particles surrounding the void will not let the air in. This phenomenon is referred to as air seal bonding.

After the mold body is stopped, the compacted mold lining retains its shape unless mechanically disturbed. The ability to successfully pour molten metal into the spinning mold without distorting the lining, is believed to be the result of the interlocking particles and discontinuous voids between the particles. It is further believed that the small angular particle size enables the formation of small voids between the particles that are discontinuous and not interconnected with adjacent voids. This results in an air impervious compacted layer of interlocking particles that is held in place by atmospheric pressure and remains stable until air is able to enter the voids. Once air is able to enter the voids, such as by mechanically disturbing the mold lining, the particles are released.

It has been found that compacting the small particles by physical or mechanical force in combination with the centrifugal force produces a smooth surface that is impervious to molten metal during casting and impervious to air. The plowing tool of the invention contacts the moving surface of the refractory material in a manner to compact the particles with sufficient force to cause the angular shaped particles to interlock and form the stable layer. The contouring tool is able to remove the outer portion of the compacted layer and form a contoured layer of dry particulate refractory material that has no soft spots, which cannot be compacted by centrifugal force alone.

A mold lining of a compacted facing layer that is substantially impervious to air requires a particulate refractory material containing at least about 50% by weight of small angular particles, such as a milled refractory flour. A large number of small particles produce a large number of discontinuous voids in the resulting compacted mold lining. The discontinuous, closed voids provide a thermal insulating effect in the mold lining, thereby reducing the conduction of heat through the mold lining and reducing the cooling rate of the casting. In contrast, a lining formed from larger refractory particles conducts heat more rapidly from the casting since heat passes through the particles at a faster rate than through the discontinuous voids. As the proportion of small particles in the mold lining increases, the number of discontinuous voids increases with a corresponding decrease in the rate of heat transfer.

Installing a clear acrylic tube in a ⅓ size demonstration hybrid centrifugal casting machine with the same ratio of inside diameter to length, with the same percent of water to volume, simulating the casting mold and volume of metal, allows one to view the shape of the paraboloidal curve for the inside surface of the molten metal in the production mold before pouring the casting.

The contour of the shape of the paraboloidal curve is controlled by:

1. RPM of the liquid, which generates centrifugal force.
   a. Little centrifugal force produces a shallow curve.
   b. Great centrifugal force produces a deep curve.
   c. The thickness of the solid metal in the nose of the molded article can be varied by changing the RPM of the mold, which changes the amount of centrifugal force generated.
2. Size of the mold, not its shape.
3. Quantity of the metal.
4. The angle of inclination of the mold body.
5. The solidification time of the metal.

When the desired flow pattern of the water is determined, the RPM of the mold is recorded and converted to centrifugal force. Casting the metal in the production mold, generating the same centrifugal force, will develop the same flow pattern on the inside surface of the casting metal.

The metal can be poured in a single pour while the mold is rotating in a vertical or upright orientation. The metal at the center of the paraboloidal curve is subject to zero gravities of force. Therefore, prior to transferring to the inclined or horizontal position the mold speed must be increased to generate sufficient centrifugal force to cause all of the molten metal to be placed onto the mold wall. Natural gravity will cause the thickness of the molten metal to vary, with the thickest portion being formed at the base of the mold wall.

With all of the molten metal distributed on the mold wall, the mold can transition and be pivoted to the inclined or horizontal position while continuously rotating the mold where the remaining molten metal will form in a straight bore, without falling back, and without being aerated and oxidized. The solidified metal in the nose will remain in place.

The thickness of the solidified metal is a function of heat transfer rate through the mold wall and time. Heat transfer rate through the mold wall can be established by experience.

When centrifugally casting a thick wall, long tubular straight bore casting in this hybrid centrifugal casting machine the metal is poured into the mold while in a near vertical position. The mold is turning at the speed to immediately place all the molten metal on the mold wall surface. When all of the molten metal reaches the mold speed and distributes itself on the mold wall, the mold is transferred to the horizontal position without falling back and without being aerated and oxidized. Molten metal spun horizontally will form a straight bore.

One preferred molded article is molded by inserting a cylindrical carbon block having a cavity in the shape of the nose section of the bomb in one end of the mold as shown in FIG. 2.

The mold lining will be a dry zircon milled refractory flour lining as disclosed in U.S. Pat. Nos. 4,124,056, 4,632,168, and 6,554,054 to Charles Noble, the refractory material is packed and contoured in place in the casting machine by machining the inside surface of the mold lining to produce the outside shape and dimension of the bomb body.

The inside surface of the metal on the butt end section of the bomb can also be cast in a paraboloidal curve shape by tilting the machine in a negative degree below the horizontal position for casting as for casting the boat tail butt end in the 500-pound Ductile Iron Bomb body program.

This method can also be used to place extra metal thickness in the closed end of a straight bore tube. The casting of the article is with computer programmed controlled servo electric motors (CNC) as follows.

1. Varying the revolutions of the mold, while in different positions with time.

2. Varying the rate of transisting through the angles of inclination with varying time.

Varying the time at each position in accordance with the solidification rate at each section of the mold.

4. Controlling the application of cooling water to maintain temperature of the mold-cooling rate of the metal.

This casting method will duplicate the contours of the inside and outside diameters of the cast article (bomb body) by the application of the properties of nature with computer programmed control.

In addition to reducing the exposure time of the metal to oxidation by reducing the pouring time, which occurs when the excess metal falls back, the metal poured into the near vertical mold closed on one end can be further shielded as follows.

1. Purge the mold with Argon.

2. Shroud the pouring spout on the bottom of the pouring ladle.

Provide an end plate on the pouring end of the mold with a swivel joint to receive the shrouded ladle-pouring spout.

3. Cover the cast metal with an insulating liquid blanket, a common practice in the steel casting industry for shielding the metal from oxygen.

4. After quickly pouring the metal, follow with quickly closing the open end of the mold with an insulated end cover to stop the convection air current from cooling the inside surface of the metal and the resulting shrinkage porosity.

Because molten metal is poured in this hybrid centrifugal casting machine with the mold in the vertical position, as described above, the mold can be transferred to any inclined mold position without the metal being aerated and oxidized. Therefore, the molten metal will be subjected to the physical influence that casting in an inclined position will impart without being subjected to falling back.

This device can be used to cast a double open-end tube or a tubular casting with one end closed.

The apparatus includes:

1. A complete machine is capable of installing refractory linings in repeated cycles in a single mold while operating 2. Separate mold lining section.

3. Separate mold casting section.

4. Mold casting section made pivotal from the horizontal position to the vertical position.

5. Water cooling of the metal mold to reduce solidification time for the casting metal.

6. Extraction of the casting by hydraulic or pneumatic push out ram from the mold.

7. Precise computer programmed control of all motions of the casting.

A) Pouring rate.

B) Mold RPM.

C) Transitioning from vertical to horizontal positions.

D Mold to change the paraboloidal shape of the liquid metal in the mold to the desired dimensions without aerating or oxidizing the metal.

While various embodiments have been chosen to illustrate the invention, it will be understood by those skilled in the art that various modifications and additions can be made without departing from the scope of the invention as defined in the appended claims.

What is claimed is:

1. A method for casting a metal article, said process comprising the steps of:

providing a mold body having a longitudinal axis with a hollow bore defining a mold cavity extending axially through said body from a first open end to a second closed end of said mold body, said second end of said body having a substantially frustoconical shape defining a surface converging toward an axial center of said mold body;

orienting said mold body in a near vertical orientation with respect to said longitudinal axis in order for the casting metal to flow on the mold lining surface, without splashing, to said closed end of the mold and rotating said mold about a vertical axis;

introducing a molten metal into said mold cavity while continuously rotating said mold body at a rotational speed sufficient to distribute said molten metal along said frustoconical shaped surface; and pivoting said mold body to orient said longitudinal axis of said mold body at an angle with respect to said vertical orientation while continuously rotating said mold body about its longitudinal axis at a rotational speed to distribute said molten metal along a length of said hollow bore in a horizontal orientation; and solidifying said molten metal to produce a centrifugal cast hollow metal article having a substantially cylindrical shaped hollow body with a closed frustoconical hollow end.

2. The method of claim 1, wherein said body of said cast metal article has a substantially uniform wall thickness.

3. The method of claim 1, comprising rotating said mold body while in said vertical orientation at a speed whereby said molten metal forms a parabola shape against said frustoconical surface, and where said mold body is pivoted to a substantially horizontal position.

4. The method of claim 1, comprising rotating said mold body while in said vertical orientation and solidifying a portion of said molten metal against said frustoconical surface to form said closed frustoconical end of said article, and thereafter rotating said mold body to said horizontal position.

5. The method of claim 1, comprising forming a compacted, densified layer of particulate refractory material on an inner surface of said mold body and thereafter introducing said molten metal into said mold body.

6. The method of claim 1, further comprising the steps of:

rotating said mold about its longitudinal axis and introducing an amount of a dry binderless particulate refractory material into said mold cavity;

distributing said refractory material along said mold cavity and contacting said refractory material with a blade having a substantially flat surface at an angle sufficient to redistribute, compact and densify said refractory material and form a compacted layer, and contacting said compacted layer with said blade, where said blade has a shaping edge to remove excess refractory material and shape said compacted layer.

7. The method of claim 6, wherein said shaping edge of said blade has a shape complementing an inner profile of said mold cavity and wherein said process forming said shaped compacted layer has a substantially uniform thickness.

8. The method of claim 6, wherein said blade has a front face and rear face and an outer face extending at an incline between said front face and said rear face to form a sharp edge, said method comprising rotating said mold body in a first direction and contacting said outer face of said blade with said refractory material at a positive angle to compact and densify said refractory material.

9. The method of claim 8, comprising rotating said mold body in a second direction and contacting said sharp edge of said blade with said refractory material at a positive angle to remove a portion of said refractory material and shape said compacted layer of said compacted material.

10. A method for casting a metal article, said process comprising the steps of:

providing a mold body having a longitudinal axis with a hollow bore defining a mold cavity extending axially through said body from a first open end to a second closed end of said mold body, said second end of said body having a substantially frustoconical shape defining a surface converging toward an axial center of said mold body;

introducing a contouring apparatus into said mold body, said contouring apparatus having a contouring blade;

orienting said mold body at an incline and introducing a first amount of dry binderless particulate refractory particles into said mold body while rotating said mold body and distributing said particles in said closed second end;

orienting said mold body in a substantially horizontal position and introducing a trough with a second amount of dry binderless refractory particles while rotating said mold body to distribute said particles and form a loose layer;

contacting said contouring blade with said loose layer to compact, redistribute and machine said particles and form an air impervious mold lining of said particles;

introducing a molten metal into said mold cavity while continuously rotating said mold body at a rotational speed sufficient to distribute said molten metal along said frustoconical shaped surface, where said mold body is oriented at a near vertical angle to introduce said molten metal into said frustoconical shaped section substantially without splashing of said molten metal; and pivoting said mold body to orient said longitudinal axis of said mold body at an angle with respect to said vertical orientation while continuously rotating said mold body about its longitudinal axis at a rotational speed to distribute said molten metal along a length of said hollow bore in a horizontal orientation; and solidifying said molten metal to produce a centrifugal cast hollow metal article having a substantially cylindrical shaped hollow body with a closed frustoconical hollow end.

11. The method of claim 10, comprising orienting said mold body in a near vertical position while introducing said molten metal into said mold body without splashing, and pivoting said mold body to a substantially horizontal position to distribute said molten metal along a length of said mold body.

12. The method of claim 10, further comprising the step of rocking said mold body in a back and forth motion while rotating said mold body to distribute said molten metal.

13. The method of claim 10, further comprising the steps of:

distributing and solidifying a selected amount of said molten metal in said closed second end of said mold body while said mold body is in said vertical orientation; and thereafter pivoting said mold body to a substantially horizontal position to cause said molten metal to be distributed and to solidify along said length of said mold body at a selected rate to form said hollow body having a predetermined wall thickness.

* * * * *